US011440329B2

(12) United States Patent
Ishizawa et al.

(10) Patent No.: US 11,440,329 B2
(45) Date of Patent: Sep. 13, 2022

(54) LIQUID EJECTING SYSTEM, SPECIFIC LIQUID CONTAINER, PROVISION METHOD, AND DELIVERY SYSTEM

(71) Applicant: SEIKO EPSON CORPORATION, Tokyo (JP)

(72) Inventors: Taku Ishizawa, Matsumoto (JP); Shuichi Koganehira, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 34 days.

(21) Appl. No.: 17/015,335

(22) Filed: Sep. 9, 2020

(65) Prior Publication Data

US 2021/0070060 A1 Mar. 11, 2021

(30) Foreign Application Priority Data

Sep. 9, 2019 (JP) ..... JP2019-163575

(51) Int. Cl.
*B41J 2/175* (2006.01)

(52) U.S. Cl.
CPC ..... *B41J 2/17566* (2013.01)

(58) Field of Classification Search
CPC ..... G06Q 20/00; G06Q 20/08; G06Q 20/085; G06Q 20/145; G06Q 20/16; G06F 3/1235; B41J 2/17566; B41J 2/17526; B41J 2/17503
See application file for complete search history.

(56) References Cited

U.S. PATENT DOCUMENTS

| | | | | |
|---|---|---|---|---|
| 2016/0288515 | A1* | 10/2016 | Matsuda | G06K 15/4075 |
| 2018/0072064 | A1* | 3/2018 | Kiyohara | B41J 2/17546 |
| 2018/0101336 | A1* | 4/2018 | Onomatsu | H04N 1/00973 |
| 2018/0131831 | A1* | 5/2018 | Tolia | H04N 1/00042 |

FOREIGN PATENT DOCUMENTS

| | | | |
|---|---|---|---|
| JP | 2003-246080 | A | 9/2003 |
| JP | 2012-210784 | A | 11/2012 |
| JP | 2014-094477 | A | 5/2014 |
| JP | 2018-039225 | A | 3/2018 |

* cited by examiner

*Primary Examiner* — Jason S Uhlenhake
(74) *Attorney, Agent, or Firm* — Oliff PLC

(57) ABSTRACT

A liquid ejecting system includes a specific liquid ejecting apparatus having a first identifier indicative of coverage by a specific service plan, and a specific liquid container having a second identifier indicative of coverage by the specific service plan. The specific liquid ejecting apparatus includes an acquisition section that acquires the second identifier, and a determination section that compares the first identifier with the acquired second identifier and determines whether the specific liquid container is usable for the specific liquid ejecting apparatus.

12 Claims, 9 Drawing Sheets

LIQUID EJECTING SYSTEM, SPECIFIC LIQUID CONTAINER, PROVISION METHOD, AND DELIVERY SYSTEM

The present application is based on, and claims priority from JP Application Serial Number 2019-163575, filed Sep. 9, 2019, the disclosure of which is hereby incorporated by reference herein in its entirety.

BACKGROUND

1. Technical Field

The present disclosure relates to techniques using a specific liquid container.

2. Related Art

Techniques in which an identification (ID) is written into the integrated circuit (IC) tag of a cartridge are known (refer to JP-A-2012-210784). In the techniques, a server includes a table in which the respective identification (ID) of each network group is set, and, when the identification (ID) of an IC tag matches an identification (ID) stored in the server, the corresponding cartridge is made usable.

Recently, companies, such as manufacturers, have provided specific service plans for printers to users in some cases. When a user uses a specific service plan, there may be a risk that the user might use a cartridge outside the coverage of the specific service plan by mistake. Such a situation is not limited to printers to which cartridges are attached, but is common to liquid ejecting apparatuses to which liquid containers are attached.

SUMMARY

According to an aspect of the present disclosure, a liquid ejecting system is provided. The liquid ejecting system includes a specific liquid ejecting apparatus having a first identifier indicative of coverage by a specific service plan, and a specific liquid container having a second identifier indicative of coverage by the specific service plan. The specific liquid ejecting apparatus includes an acquisition section that acquires the second identifier, and a determination section that compares the first identifier with the acquired second identifier and determines whether the specific liquid container is usable for the specific liquid ejecting apparatus.

DESCRIPTION OF EXEMPLARY EMBODIMENTS

A. First Embodiment

Figure 1:
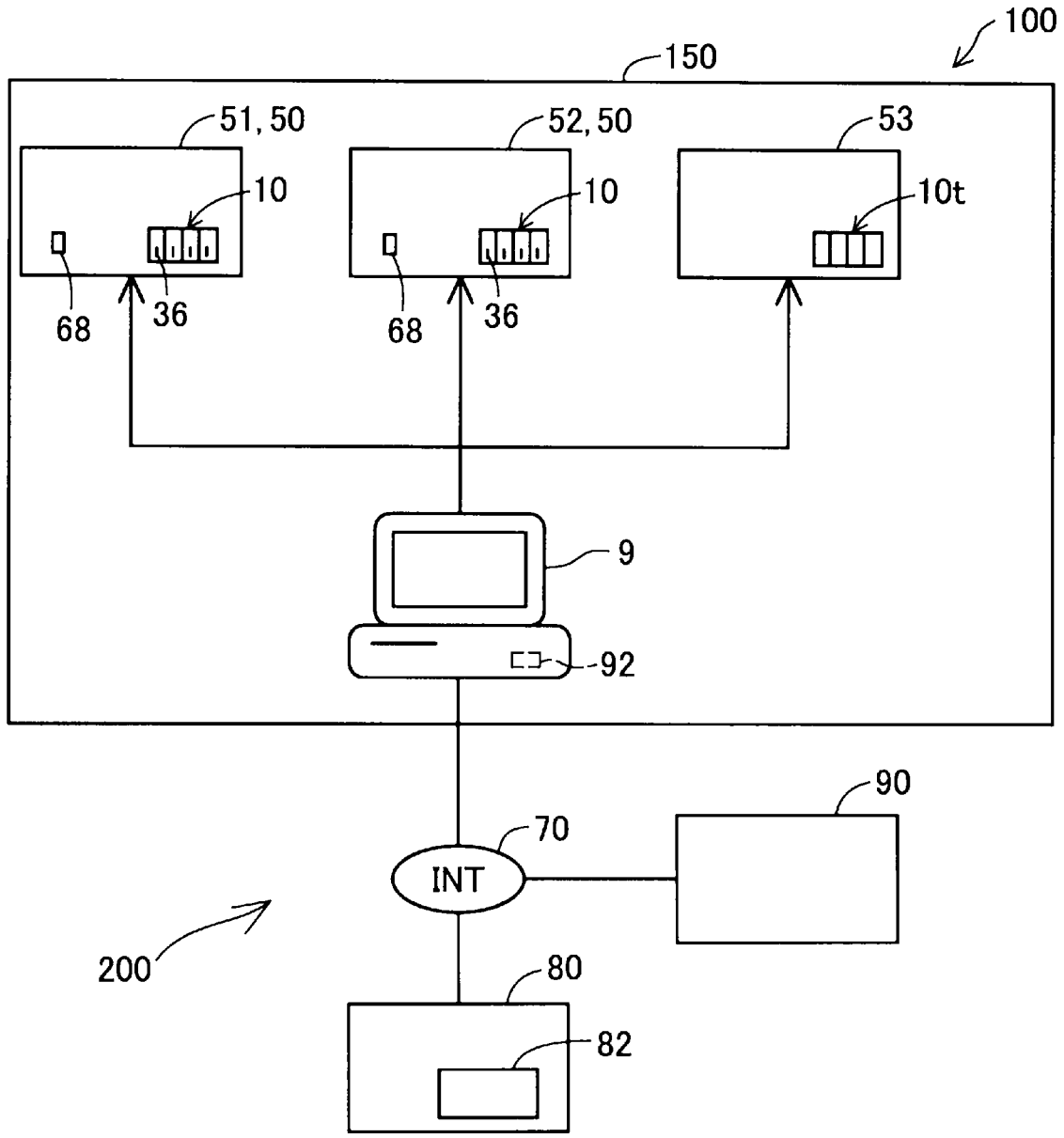
FIG. 1 is a diagram illustrating a delivery system according to a first embodiment of the present disclosure.

FIG. 1 is a diagram illustrating a delivery system 200 according to a first embodiment of the present disclosure. The delivery system 200 includes a liquid ejecting system 100, a vendor 80, and a server 90. The liquid ejecting system 100 includes a liquid ejecting apparatuses 51, 52, and 53 as ink jet printers. The delivery system 200 is a system that delivers specific liquid containers 10 covered by a specific service plan to a contractor 150 of the specific service plan so as to use the specific liquid containers 10 for the specific liquid ejecting apparatuses 50 covered by the same specific service plan as the specific liquid containers 10. The vendor 80 may include the server 90.

The specific service plan is a contract established between the vendor 80 and the contractor 150, such as an individual or a company. Examples of the specific service plan include a flat-rate service plan and a usage-based service plan. The flat-rate service plan is a service plan in which, when the contractor 150 pays a fixed fee, which is a predetermined monthly or yearly fee, to the vendor 80, a substantially unlimited number of copies may be printed by the specific liquid ejecting apparatuses 50 covered by this service plan. That is, in the flat-rate service plan, for a predetermined fixed fee, the contractor 150 may use the specific liquid containers 10 for the specific liquid ejecting apparatuses 50 unlimitedly. In the flat-rate service plan, when the amount of a liquid remaining in the specific liquid container 10 used for the specific liquid ejecting apparatus 50 becomes zero, the contractor 150 places an order for the specific liquid container 10 with the server 90 via the network 70. Upon receiving the order for the specific liquid container 10 via the server 90, the vendor 80 delivers a new specific liquid container 10 to the contractor 150.

The usage-based service plan is a service plan in which when the amount of usage of the specific liquid ejecting apparatuses 50 is less than or equal to a predetermined amount of usage, the monthly or yearly fee is fixed. As the amount of usage, the number of copies printed by the specific liquid ejecting apparatuses 50, for example, is used. For example, on a per-month basis, the contractor 150 pays a fixed fee to the vendor 80 when the number of printed copies is less than or equal to a predetermined number and pays an excess fee for each excess number to the vendor 80 when the number of printed copies is greater than the predetermined number. The amount of usage may be, instead of the number of printed copies, the number of used specific liquid containers 10 or the amount of usage of liquids accommodated in the specific liquid containers 10. For example, on a per-month basis, the contractor 150 may pay a fixed fee to the vendor 80 when the number of used specific liquid containers 10 is less than or equal to a predetermined number and pay an excess fee for each excess number to the vendor 80 when the number of used specific liquid containers 10 is greater than the predetermined number. According to the present embodiment, the contractor 150 uses the usage-based service plan.

The liquid ejecting system 100 includes the specific liquid ejecting apparatuses 50 covered by the specific service plan and the specific liquid containers 10 covered by the same specific service plan as the specific liquid ejecting apparatuses 50. According to the present embodiment, a plurality of specific liquid ejecting apparatuses 50 are provided. When two specific liquid ejecting apparatuses 50 are discriminated from each other, they are referred to as a first specific liquid ejecting apparatus 51 and a second specific liquid ejecting apparatus 52. Each of the plurality of specific liquid ejecting apparatuses 50 has a first identifier 68 indicative of coverage by the specific service plan. The respective first identifiers 68 of the plurality of specific liquid ejecting apparatuses 50 may be the same or may be different. According to the present embodiment, the respective first identifiers 68 of the plurality of specific liquid ejecting apparatuses 50 are the same and are "AABB01". The specific liquid container 10 has a second identifier 36 indicative of coverage by the specific service plan. The second identifier 36 includes information related to the first identifier 68 so as to enable the specific liquid container 10 to be used for the specific liquid ejecting apparatus 50. When there are a plurality of specific liquid containers 10, the respective second identifiers 36 of the specific liquid containers 10 may be the same or may be different. The first identifier 68 and the second identifier 36 are sufficient if they may specify the specific liquid ejecting apparatus 50 and the specific liquid container 10, and are, for example, expressed by a combination of two or more alphanumeric characters, or the like. The specific liquid container 10 is an ink cartridge detachably attached to the specific liquid ejecting apparatus 50.

The liquid ejecting system 100 further includes a liquid ejecting apparatus 53 outside the coverage of the specific service plan, a liquid container 10*t* outside the coverage of the specific service plan, and a control device 9 including a control driver 92 for instructing the liquid ejecting apparatuses 51, 52, and 53 to perform printing operations. The control device 9 is, for example, a personal computer and is coupled to an external device, for example the server 90, via the network 70 such as the Internet. The specific liquid ejecting apparatus 50 is coupled to the network 70 via the control device 9 according to the present embodiment but may be coupled not via the control device 9.

The server 90 is communicably coupled to the liquid ejecting system 100 via the network 70 and manages order receipt and delivery of the specific liquid container 10. The vendor 80 produces and delivers the specific liquid container 10 in accordance with the order details and the delivery details received from the server 90. The vendor 80 includes an identifier generating device 82. The identifier generating device 82 generates the second identifier 36 from the first identifier 68 by using a predetermined algorithm. It is desirable that the second identifier 36 include information related to the first identifier 68 of the specific liquid ejecting apparatus 50. Therefore, it is desirable that the predetermined algorithm be, for example, an algorithm according to which the second identifier 36 includes information related to the first identifier 68. Specifically, the predetermined algorithm may be an algorithm according to which the first identifier 68 is used as is as the second identifier 36, or may be an algorithm according to which a predetermined digit is appended to the end of the first identifier 68. Additionally, when the predetermined algorithm deals with a plurality of first identifiers 68, the predetermined algorithm may be an algorithm according to which the second identifier 36 is created by arranging the characters of the plurality of first identifiers 68 side by side so that information related to each of the first identifiers 68 is included, or may be an algorithm according to which a digit is further added to the end of the arranged characters. Additionally, when the plurality of first identifiers 68 are the same identifier, the predetermined algorithm may be an algorithm according to which the first identifier 68 is set as the second identifier 36 so that information related to the plurality of first identifiers 68 is included. Furthermore, the predetermined algorithm may also include an algorithm for encrypting the second identifier 36. The second identifier 36 may be easily generated by generating the second identifier 36 from the first identifier 68 by using the predetermined algorithm. The generated second identifier 36 is recorded on a recording medium described later included in the specific liquid container 10.

Figure 2:
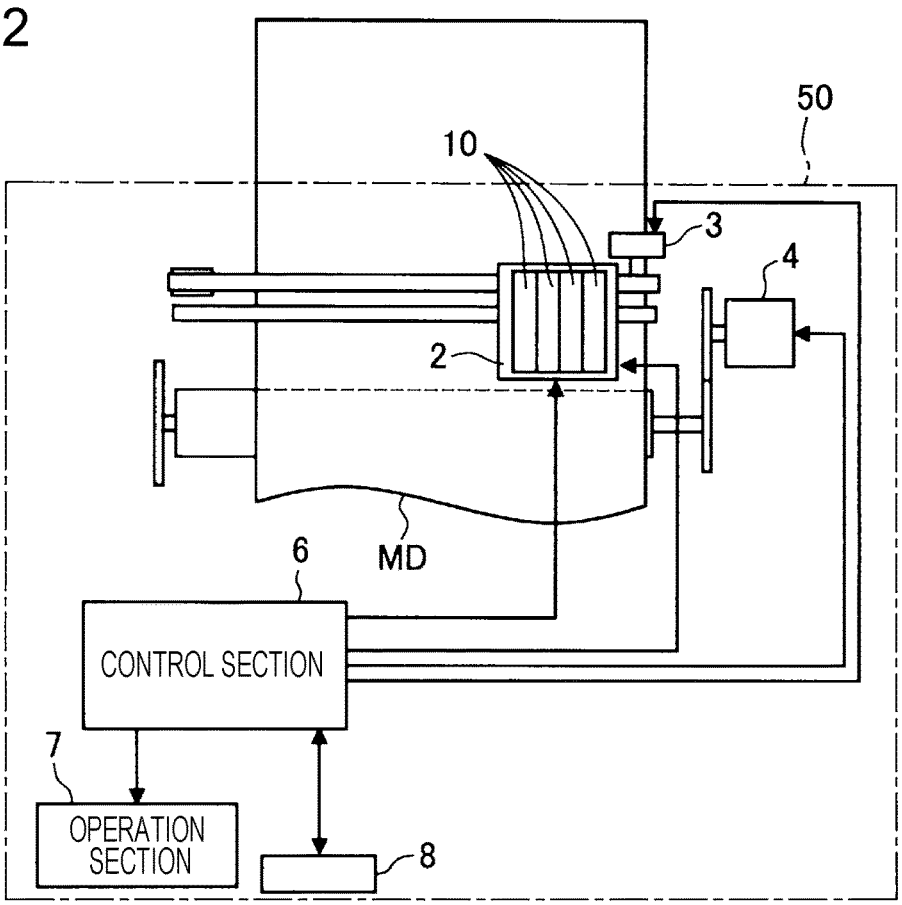
FIG. 2 is a diagram illustrating a schematic configuration of a specific liquid ejecting apparatus.

FIG. 2 is a diagram illustrating a schematic configuration of the specific liquid ejecting apparatus 50. The specific liquid ejecting apparatus 50 includes a holder 2 to which a plurality of specific liquid containers 10 are detachably attached, a first motor 3, a second motor 4, a control section 6, an operation section 7, and an interface 8.

The holder 2 includes a discharge head (not illustrated) that discharges ink, at the side facing a medium MD. Additionally, the specific liquid containers 10 are detachably attached to the holder 2. Ink of colors of cyan, magenta, yellow, and black is accommodated in the respective specific liquid containers 10. A liquid accommodated in the specific liquid container 10 is supplied to the discharge head of the holder 2, and the liquid is discharged onto the medium MD, such as a paper sheet.

The first motor 3 drives the holder 2 in the main scanning direction. The second motor 4 transports the medium MD in the sub-scanning direction. The control section 6 controls the entire operations of the specific liquid ejecting apparatus 50.

Based on print data received from the control device 9 illustrated in FIG. 1 to which the control section 6 is coupled via the interface 8, the control section 6 controls the first motor 3, the second motor 4, and the discharge head so as to perform printing. The control section 6, to which the operation section 7 is coupled, accepts various operations from a user.

Figure 3:
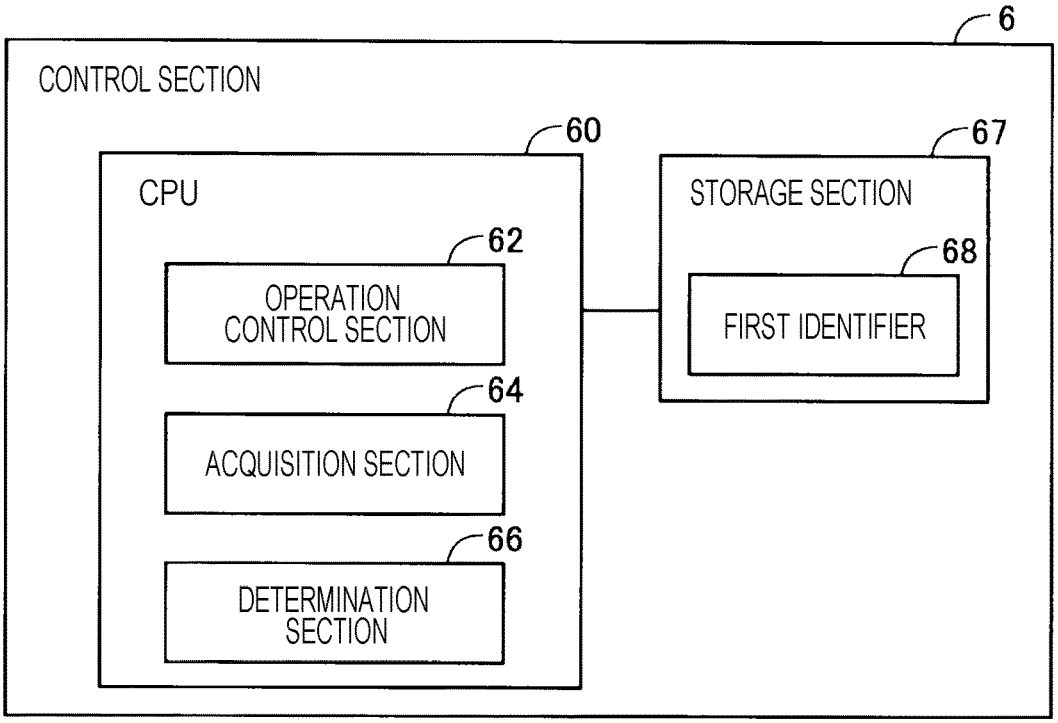
FIG. 3 is an internal block diagram of a control section.

FIG. 3 is an internal block diagram of the control section 6. The control section 6 includes a central processing unit (CPU) 60 and a storage section 67. The CPU 60 executes various programs stored in the storage section 67 to thereby function as an operation control section 62, an acquisition section 64, and a determination section 66. The storage section 67 is made of a semiconductor memory, such as a read-only memory (ROM) or a random-access memory (RAM). The storage section 67 stores various programs to be executed by the CPU 60, and the first identifier 68. The first identifier 68 is transmitted from the vendor 80 to the control device 9 via the network 70, for example, when the contractor 150 signs a contract for the specific service plan with the vendor 80 via the control device 9. The transmitted first identifier 68 is written to the storage section 67 of the specific liquid ejecting apparatus 50 covered by the specific service plan. Additionally, when the contractor 150 cancels or stops the specific service plan, an instruction to delete the first identifier 68 is sent from the vendor 80 via the network 70, and then the first identifier 68 is deleted from the storage section 67.

The operation control section 62 controls operations of the specific liquid ejecting apparatus 50 according to an instruction from the control driver 92 and an instruction accepted via the operation section 7.

The acquisition section 64 acquires the second identifier 36 from the specific liquid container 10 attached to the holder 2. Specifically, the holder 2 includes an electrical terminal. When attached to the holder 2, the specific liquid container 10 or the liquid container 10*t* is electrically coupled to the control section 6. This enables various types of information, such as the second identifier 36, to be exchanged between the control section 6 and the specific liquid container 10 or the liquid container 10*t*.

The determination section 66 compares the first identifier 68 with the acquired second identifier 36 and determines whether the specific liquid container 10 is usable for the specific liquid ejecting apparatus 50. For example, when the second identifier 36 of the specific liquid container 10 is "AAABB01", which includes information related to the first identifier 68 of the specific liquid ejecting apparatus 50, it is determined that the specific liquid container 10 is usable. However, when the second identifier 36 of the specific liquid container 10 does not include information related to the first identifier 68 or when the second identifier 36 is not provided and is unable to be acquired, it is determined that the specific liquid container 10 is not usable.

The liquid ejecting apparatus 53, which is outside the coverage of the specific service plan, differs from the specific liquid ejecting apparatus 50 mainly in that the liquid ejecting apparatus 53 does not store the first identifier 68 in the storage section 67. Therefore, in the liquid ejecting apparatus 53, when, even though the acquisition section 64 has acquired the second identifier 36, the determination section 66 compares the second identifier 36 with the first identifier 68, the second identifier 36 does not match the first identifier 68 since the first identifier 68 is blank information. Consequently, the determination section 66 of the liquid ejecting apparatus 53 determines that the specific liquid container 10 having the second identifier 36 is not usable. However, when the liquid container 10*t*, which does not have the second identifier 36 and is outside the coverage of the specific service plan, is attached to the holder 2, the determination section 66 of the liquid ejecting apparatus 53 determines that the liquid container 10*t* is usable. That is, when comparing the first identifier 68 with the second identifier 36, the determination section 66 of the liquid ejecting apparatus 53 determines that the liquid container 10*t* is usable since the information acquired from the liquid container 10*t* by the acquisition section 64 does not include the second identifier 36.

Figure 4:
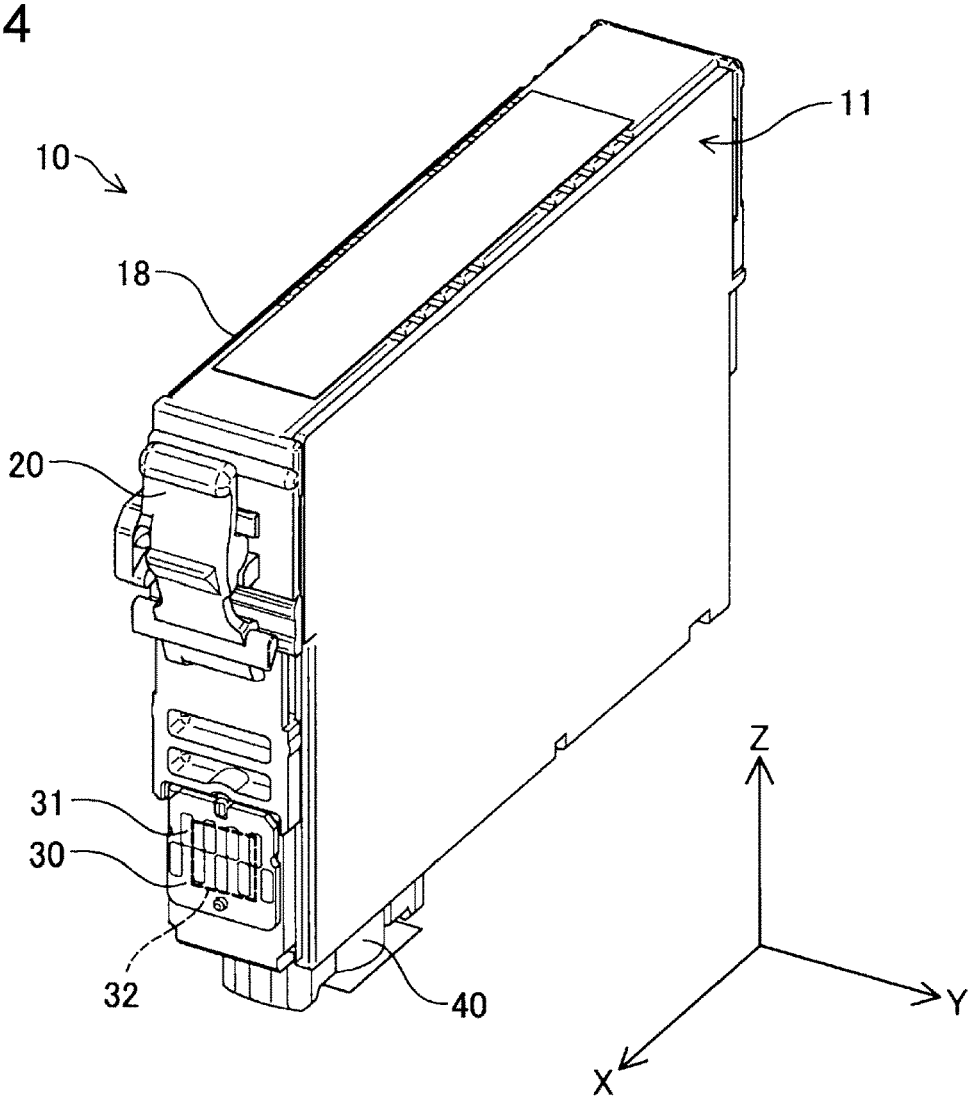
FIG. 4 is an external perspective view of a specific liquid container.

FIG. 4 is an external perspective view of the specific liquid container 10. The specific liquid container 10, which is a liquid container, includes a container main body 11 constituting an outer casing, and a circuit board 30 mounted on the container main body 11. The container main body 11 accommodates a liquid for supply to the specific liquid ejecting apparatus 50. The container main body 11 further includes a liquid supply port 40 for supplying the accommodated liquid to the specific liquid ejecting apparatus 50 and a lever 20 for operating the attachment and detachment to the holder 2.

The circuit board 30 includes a plurality of electrical terminals 31 on the front surface, and a recording medium 32, which is electrically coupled to the electrical terminals 31, on the back surface. When attached to the holder 2 of the specific liquid ejecting apparatus 50 or the holder 2 of the liquid ejecting apparatus 53, the plurality of electrical terminals 31 are in contact to the electrical terminals of the holder 2. This enables information exchange between the control section 6 of the specific liquid ejecting apparatus 50 or the liquid ejecting apparatus 53 and the recording medium 32 of the specific liquid container 10. The recording medium 32 according to the present embodiment is a storage device including a semiconductor memory.

Figure 5:
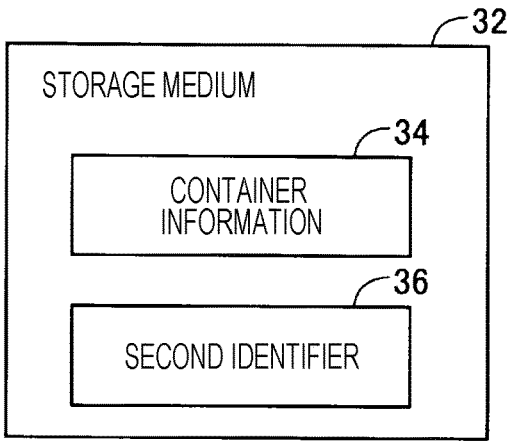
FIG. 5 is an internal block diagram of a recording medium.

FIG. 5 is an internal block diagram of the recording medium 32. The recording medium 32 includes container information 34 and the second identifier 36. The container information 34 is information about the specific liquid container 10 and, for example, includes the color information of the accommodated liquid, the date of manufacture, and the remaining liquid amount. The container information 34 is written to the recording medium 32 at the time of manufacture of the specific liquid container 10. Information on the remaining liquid amount may be overwritten via the control section 6 in accordance with the usage state. The second identifier 36 is generated in association with the first identifier 68 of the specific liquid ejecting apparatus 50 to be used by the contractor 150 of the specific service plan, by the identifier generating device 82, and then is written to the recording medium 32. That is, the second identifier 36 is information indicative of coverage by the same specific service plan as that applied to the specific liquid ejecting apparatus 50.

Figure 6:
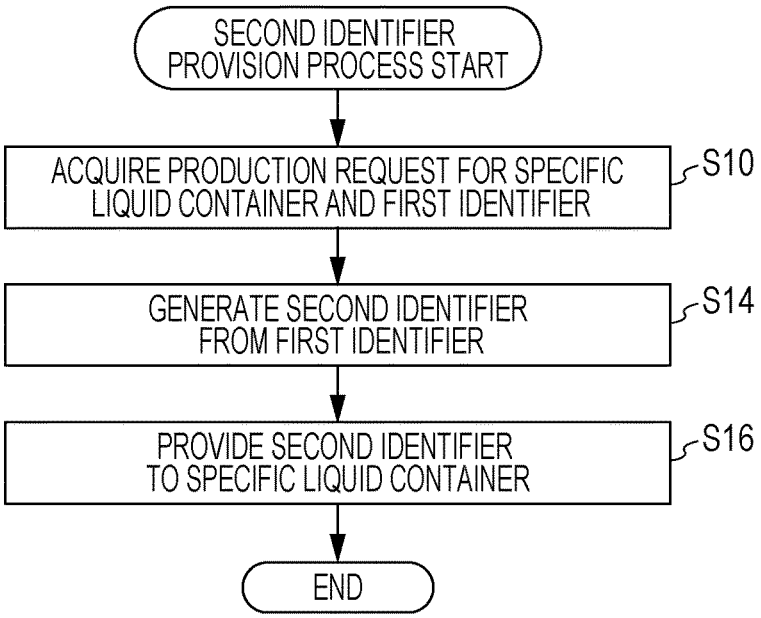
FIG. 6 is a flowchart illustrating a provision process.

FIG. 6 is a flowchart illustrating a provision process of providing the second identifier 36, which is indicative of coverage by the specific service plan, to the specific liquid container 10. First, in step S10, the vendor 80 acquires a request for production of the specific liquid container 10, and the first identifier 68. For example, at a time when the amount of a liquid remaining in the specific liquid container 10 used for the specific liquid ejecting apparatus 50 becomes very little, the contractor 150 places an order for a new specific liquid container 10 to the server 90 by using the control device 9. In placing an order, the contractor 150 transmits information for identifying the contractor 150, the first identifier 68 of the specific liquid ejecting apparatus 50 covered by the specific service plan, and the type and the number of the specific liquid containers 10 to be ordered, as ordering information, to the server 90 via the network 70. The server 90 transmits the acquired ordering information to the vendor 80, and thereby the vendor 80 acquires the production request and the first identifier 68.

Subsequently, in step S14, the identifier generating device 82 generates the second identifier 36 from the acquired first identifier 68 by using a predetermined algorithm. In step S16, the vendor 80 causes the generated second identifier 36 to be stored in the recording medium 32 of the specific liquid container 10, thereby providing the second identifier 36 to the specific liquid container 10. The specific liquid container 10 to which the second identifier 36 is provided is delivered to the contractor 150.

Figure 7:
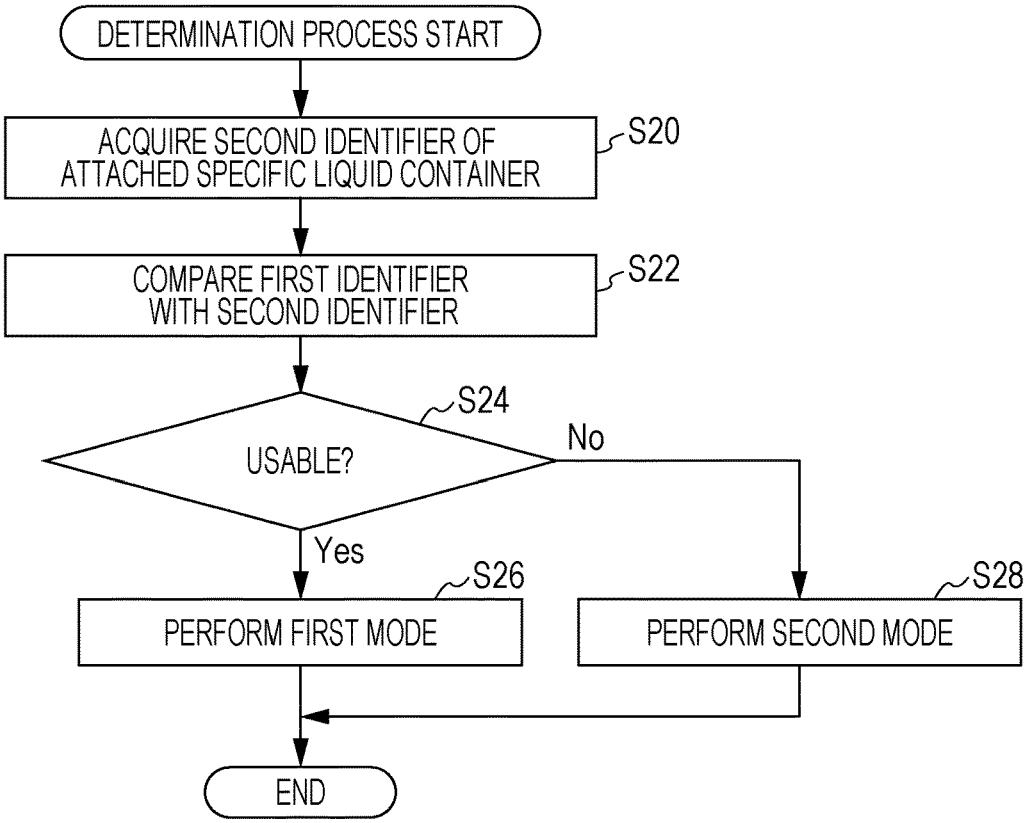
FIG. 7 is a flowchart illustrating a determination process.

FIG. 7 is a flowchart illustrating a determination process executed by the control section 6 of the specific liquid ejecting apparatus 50. The determination process is executed when the specific liquid container 10 or the liquid container 10*t* is attached to the holder 2. According to the present embodiment, the determination process is executed immediately after the specific liquid container 10 or the liquid container 10*t* is attached to the holder 2. However, the determination process is not limited to this, but may be executed after a predetermined amount of a liquid has been consumed.

First, in step S20, the acquisition section 64 acquires the second identifier 36 of the specific liquid container 10 or the liquid container 10*t* attached to the holder 2. Next, in step S22, the determination section 66 compares the first identifier 68 of the specific liquid ejecting apparatus 50 with the acquired second identifier 36. Next, in step S24, the determination section 66 determines, as a result of the comparison between the first identifier 68 and the second identifier 36, whether the specific liquid container 10 or the liquid container 10*t* attached to the holder 2 is usable for the specific liquid ejecting apparatus 50.

If, in step S24, the determination of "usable" is made, in step S26, the operation control section 62 performs a first mode as the operation mode of the specific liquid ejecting apparatus 50. The first mode is a normal operation mode and is a mode of performing printing operations according to a printing instruction from the control driver 92 or the like.

If, in step S24, the determination of "not usable" is made, in step S28, the operation control section 62 performs a second mode as the operation mode. The second mode is an operation mode different from the normal operation mode. The second mode is, for example, a mode of stopping printing operations regardless of a printing instruction. The content of the second mode is not limited to this. For example, in the second mode, the operation control section 62 may provide a user, via a monitor or the like of the control device 9, with a report noting that the attached specific liquid container 10 or the attached liquid container 10*t* is outside the coverage of the specific service plan of the specific liquid ejecting apparatus 50. Additionally, for example, in the second mode, the operation control section 62 may notify the vendor 80 or a company that manages the specific liquid container 10 and the liquid container 10*t*, via the network 70, that the attached specific liquid container 10 or the attached liquid container 10*t* is outside the coverage of the specific service plan of the specific liquid ejecting apparatus 50.

According to the first embodiment described above, the determination section 66 compares the first identifier 68 and the second identifier 36, which are indicative of coverage by the specific service plan, and determines whether the specific liquid container 10 is usable. This may reduce the possibility that the liquid container 10*t*, which is outside the coverage of the specific service plan, might be used for the specific liquid ejecting apparatus 50. Additionally, for example, the possibility that an unexpected liquid might be used for the specific liquid ejecting apparatus 50 may be reduced. This may inhibit problems, such as nozzle clogging, in the specific liquid ejecting apparatus 50. Additionally, according to the first embodiment described above, the second identifier 36 includes the information related to the first identifier 68. This makes it easier for the determination section 66 to determine whether the specific liquid container 10 is usable. Additionally, according to the first embodiment described above, the specific liquid container 10 has the second identifier 36 indicative of coverage by the same specific service plan as the specific liquid ejecting apparatus 50. This enables the determination section 66 to easily differentiate between the specific liquid container 10, which is usable for the specific liquid ejecting apparatus 50, and the liquid container 10*t*, which is not usable for the specific liquid ejecting apparatus 50. Additionally, according to the first embodiment described above, the identifier generating device 82 generates the second identifier 36 from the first identifier 68 by using the predetermined algorithm. Therefore, the specific liquid container 10 covered by the specific service plan may be easily manufactured. Additionally, the specific liquid container 10 may be manufactured after receipt of a request for delivery of the specific liquid container 10 from the contractor 150.

B. Second Embodiment

Figure 8:
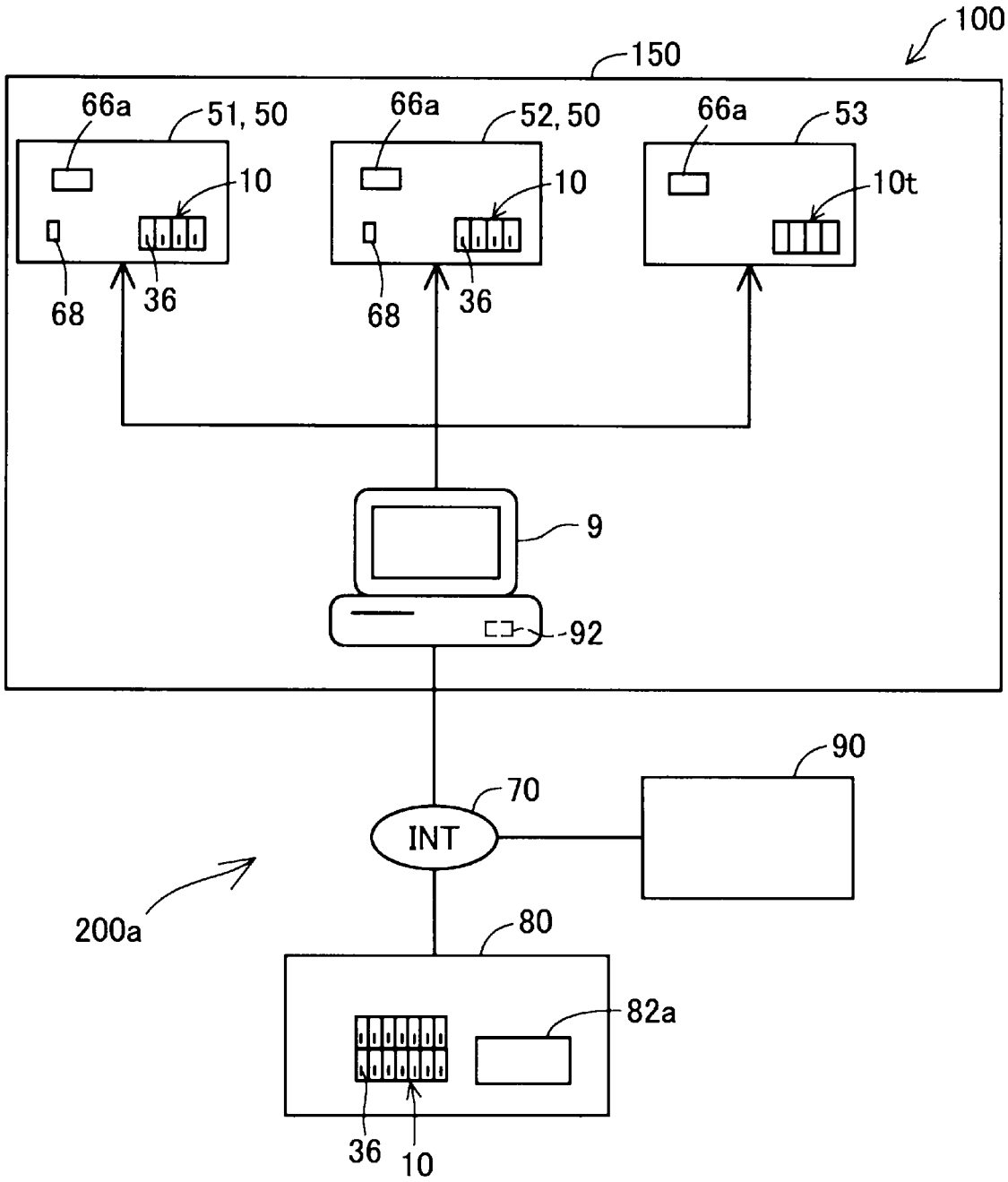
FIG. 8 is a diagram illustrating a delivery system according to a second embodiment of the present disclosure.

FIG. 8 is a diagram illustrating a delivery system 200*a* according to a second embodiment of the present disclosure. The differences between the delivery system 200 according to the first embodiment and the delivery system 200*a* according to the second embodiment are an identifier generating device 82*a* and a determination section 66*a*. The identifier generating device 82*a* generates the second identifier 36 without using the predetermined algorithm. That is, the identifier generating device 82*a* generates the second identifier 36 without using the first identifier 68. The generated second identifier 36 is recorded on the recording medium 32 of the circuit board 30. The circuit board 30, on which the second identifier 36 is recorded, is attached to the specific liquid container 10 or the liquid container 10*t*, and thereby the specific liquid container 10 or the liquid container 10*t* is stored as an item in stock in the vendor 80.

Figure 9:
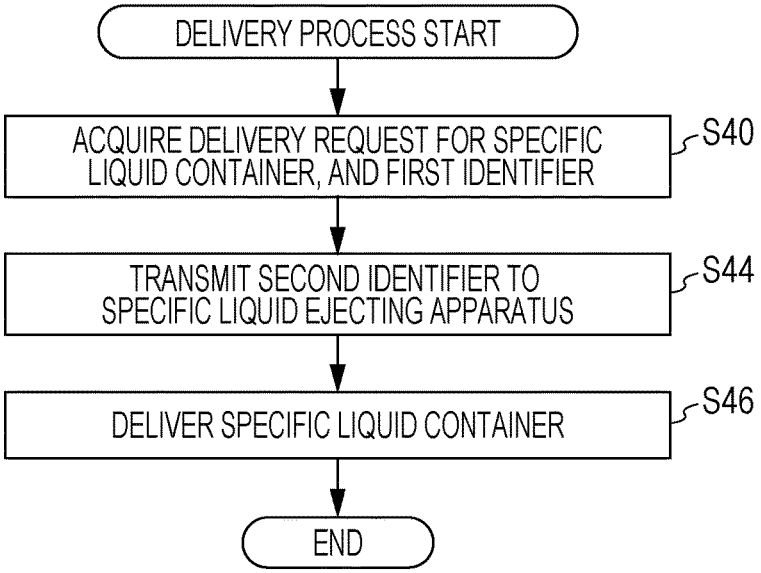
FIG. 9 is a flowchart illustrating a delivery process executed by a delivery system.

FIG. 9 is a flowchart illustrating a delivery process executed by the delivery system 200*a*. In step S40, the server 90 acquires a request for delivery of the specific liquid container 10 and the first identifier 68 from the contractor 150 or the like via the network 70. For example, at a time when the amount of a liquid remaining in the specific liquid container 10 used for the specific liquid ejecting apparatus 50 becomes very little, the contractor 150 places an order for a new specific liquid container 10 to the server 90 by using the control device 9. In placing an order, the contractor 150 transmits information for specifying the contractor 150, the first identifier 68 of the specific liquid ejecting apparatus 50 covered by the specific service plan, and the type and the number of the specific liquid containers 10 to be ordered, as ordering information, to the server 90 via the network 70. The server 90 transmits the acquired ordering information to the vendor 80, and thereby the vendor 80 acquires the delivery request and the first identifier 68.

In step S44, in response to the delivery request, the server 90 transmits the second identifier 36 of the specific liquid container 10 to be delivered to the contractor 150, to the specific liquid ejecting apparatus 50 having the first identifier 68 of the delivery request source. Specifically, upon acquiring the ordering information, the vendor 80 selects the specific liquid container 10 that satisfies the ordering information, such as the quantity and ink color, from items in stock and carries out preparatory work for delivery of the selected specific liquid container 10 to the contractor 150. Prior to delivery, the vendor 80 transmits, to the server 90, the second identifier 36 of the specific liquid container 10 to be delivered to the contractor 150, and the server 90 transmits the received second identifier 36 to the control driver 92 via the network 70. Upon receiving the second identifier 36, the control driver 92 transmits the second identifier 36 to the specific liquid ejecting apparatus 50 having the first identifier 68. The second identifier 36 transmitted from the server 90 is stored in the storage section 67 of the specific liquid ejecting apparatus 50. Next, the vendor 80, in step S46, delivers the specific liquid container 10 to the contractor 150.

Figure 10:
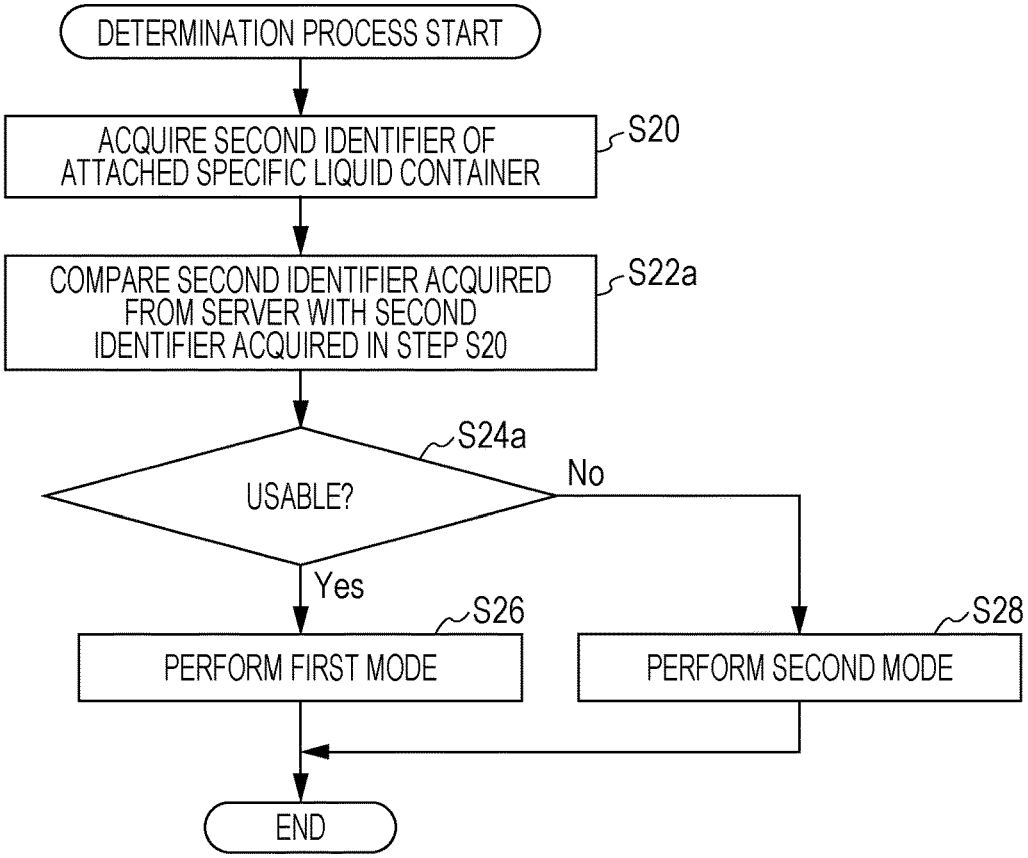
FIG. 10 is a flowchart illustrating a determination process.

FIG. 10 is a flowchart illustrating a determination process executed by the control section 6 of the specific liquid ejecting apparatus 50. The determination process is executed when the specific liquid container 10 or the liquid container 10*t* is attached to the holder 2. According to the present embodiment, the determination process is executed immediately after the specific liquid container 10 or the liquid container 10*t* is attached to the holder 2. However, the determination process is not limited to this, but may be executed after a predetermined amount of a liquid has been consumed. Differences from the determination process illustrated in FIG. 7 are process details of step S22*a* and step S24*a*. The other steps are substantially the same as those in the determination process illustrated in FIG. 7, and thus substantially the same steps are denoted by the same reference numerals and description thereof is omitted.

In step S22*a*, the determination section 66*a* compares the second identifier 36 acquired in advance from the server 90 with the second identifier 36 acquired in step S20. In step S24*a*, the determination section 66*a* determines whether the specific liquid container 10 or the liquid container 10*t* attached to the holder 2 is usable for the specific liquid ejecting apparatus 50. Specifically, if the second identifier 36 acquired from the server 90 matches the second identifier 36 acquired by the acquisition section 64 in step S20, the determination section 66*a* determines that the specific liquid container 10 is usable. However, if the second identifier 36 acquired from the server 90 does not match the second identifier 36 acquired in step S20, or if the second identifier 36 is not included in the information acquired in step S20, the determination section 66*a* determines that the specific liquid container 10 or the liquid container 10*t* is not usable.

According to the second embodiment described above, substantially the same advantages are achieved for the points having substantially the same configuration as in the first embodiment described above. Additionally, according to the second embodiment described above, the server 90 transmits the second identifier 36 of the specific liquid container 10 to be delivered, to the specific liquid ejecting apparatus 50 having the first identifier 68. By using the transmitted second identifier 36 and the second identifier 36 acquired by the acquisition section 64, the determination section 66 determines whether the specific liquid container 10 is usable. This may reduce the possibility that the liquid container 10*t*, which is outside the coverage of the specific service plan, might be used for the specific liquid ejecting apparatus 50. The second identifier 36 of the specific liquid container 10 to be delivered is transmitted to the specific liquid ejecting apparatus 50. Thereby, the specific liquid container 10 may be manufactured and stored prior to order placement.

C. Third Embodiment

Figure 11:
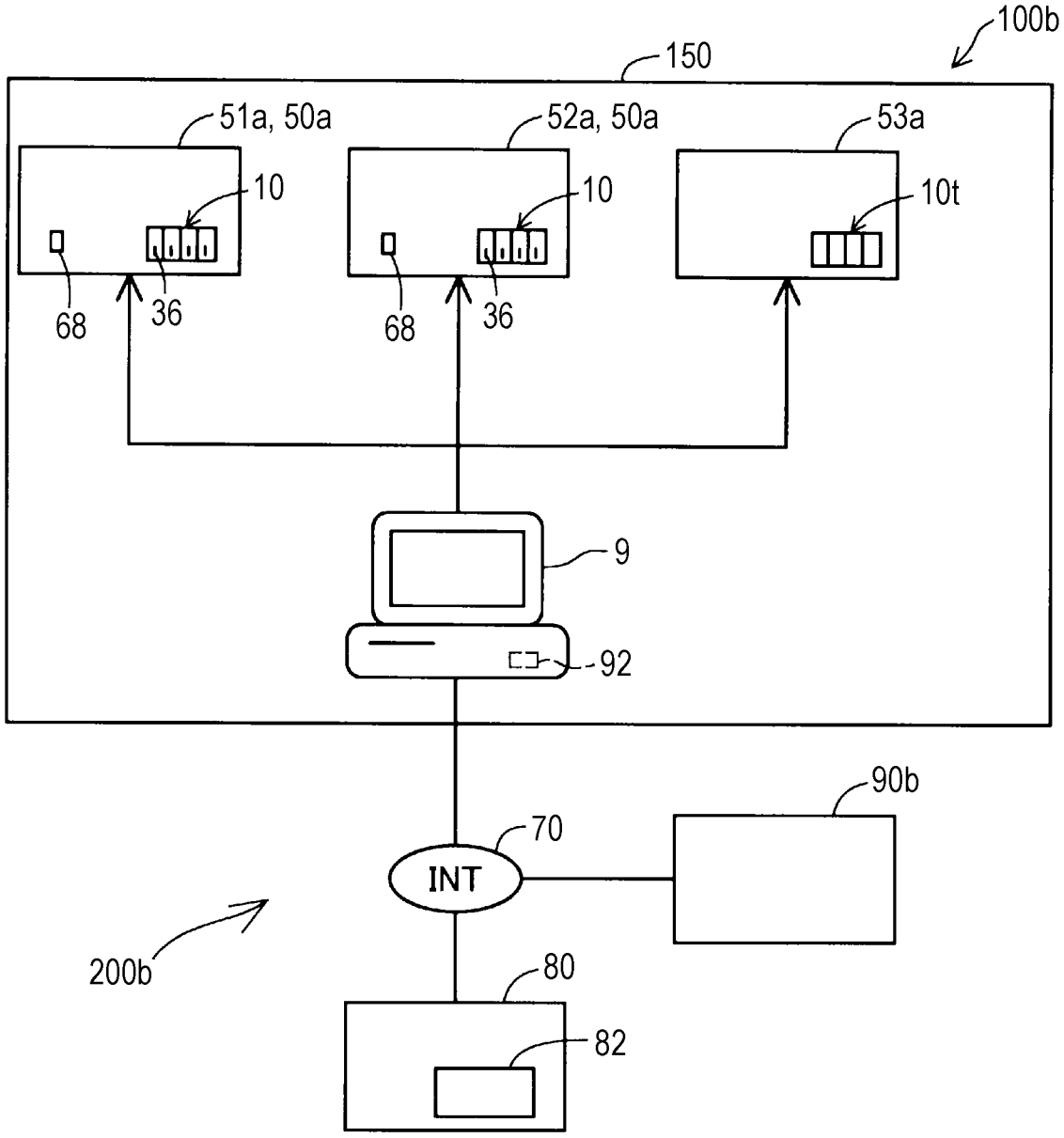
FIG. 11 is a diagram illustrating a delivery system according to a third embodiment of the present disclosure.

FIG. 11 is a diagram illustrating a delivery system 200*b* according to a third embodiment of the present disclosure. Differences from the delivery system 200 according to the first embodiment illustrated in FIG. 1 are that a server 90*b* determines whether the specific liquid container 10 or the liquid container 10*t* is usable for a specific liquid ejecting apparatus 50*a*. That is, the specific liquid ejecting apparatus 50*a* or the liquid ejecting apparatus 53*a* in the liquid ejecting system 100*b* is not limited to including the acquisition section 64 and the determining section 66. For a configuration that is substantially the same between the delivery system 200*b* according to the third embodiment and the delivery system 200 according to the first embodiment, the same reference numerals are used and repetitive description is omitted.

Figure 12:
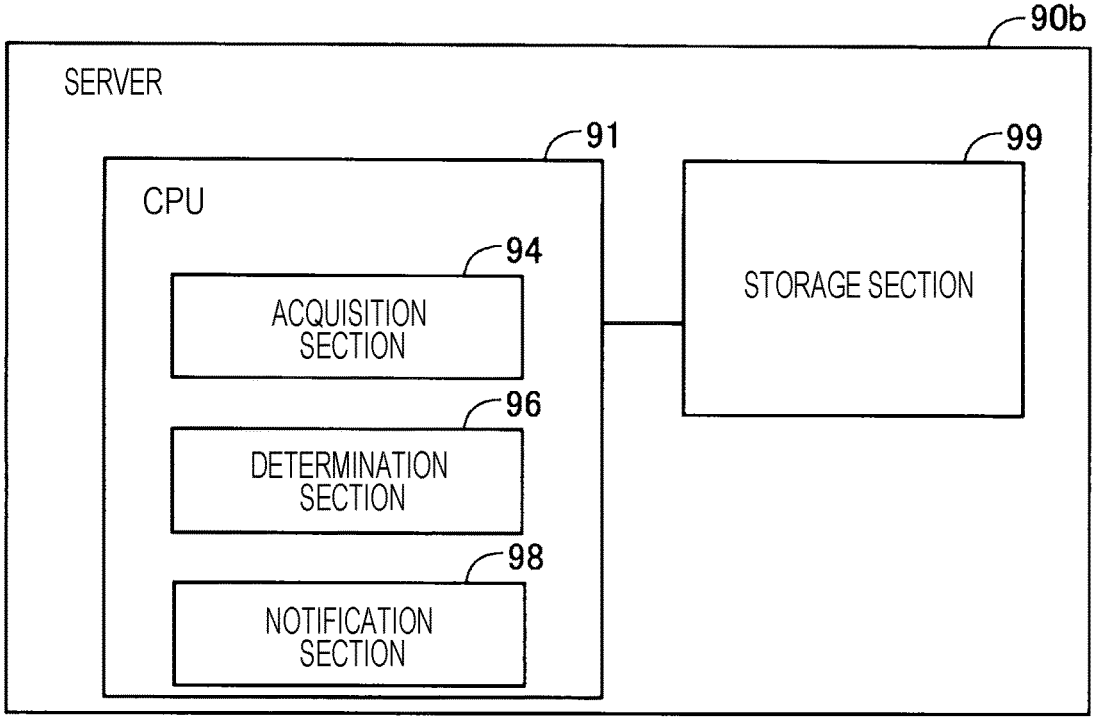
FIG. 12 is an internal block diagram of a server.

FIG. 12 is an internal block diagram of the server 90*b*. The server 90*b* includes a CPU 91 and a storage section 99. The CPU 91 executes various programs stored in the storage section 99 to thereby function as an acquisition section 94, a determination section 96, and a notification section 98. At a predetermined timing, the acquisition section 94 acquires the first identifier 68 from the specific liquid ejecting apparatus 50*a* and the second identifier 36 of the specific liquid container 10 attached to the holder 2. When the liquid container 10*t* that does not have the second identifier 36 is attached to the holder 2, the acquisition section 94 handles the second identifier 36 as blank information. Information of the first identifier 68 and the second identifier 36 acquired by the acquisition section 94 is stored in the storage section 99.

The determination section 96 compares the acquired first identifier 68 with the acquired second identifier 36 and determines whether the specific liquid container 10 is usable for the specific liquid ejecting apparatus 50*a*. The method for this determination is substantially the same as that of the determination section 66 according to the first embodiment, and therefore description thereof is omitted. The notification section 98 notifies the specific liquid ejecting apparatuses 50*a* of a determination result of the determination section 96 via the network 70. Upon receiving the determination result from the notification section 98, a first specific liquid ejecting apparatus 51*a* and a second specific liquid ejecting apparatus 52*a* perform an operation mode, one of the first mode and the second mode, in accordance with the determination result. Specifically, if the determination result is "usable", the first mode, which is the normal mode, is performed whereas if the determination result is "not usable", the second mode is performed.

According to the third embodiment, the server 90*b* compares the first identifier 68 with the second identifier 36 and determines whether the specific liquid container 10 is usable for the specific liquid ejecting apparatus 50*a*. This may reduce the possibility that the liquid container 10*t*, which is outside the coverage of the specific service plan, might be used for the specific liquid ejecting apparatus 50*a*. Since it is determined by the server 90*b* whether the specific liquid container 10 is usable, the specific liquid ejecting apparatus 50*a* is not limited to having capabilities for determining whether the specific liquid container 10 is usable.

D. Other Embodiments

D-1. First Other Embodiment

Figure 13:
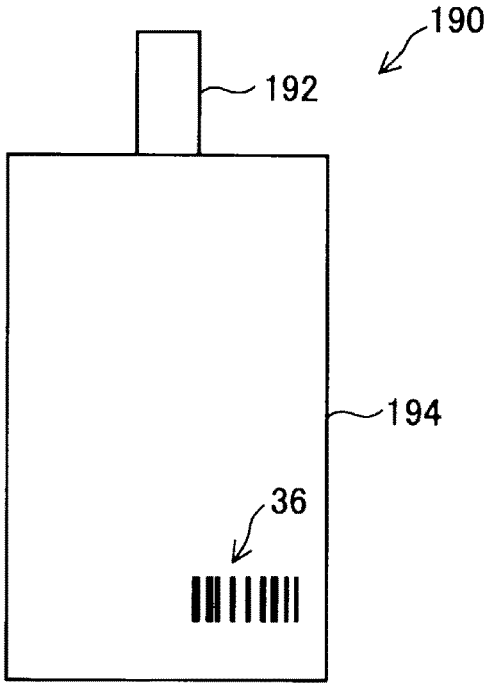
FIG. 13 is a diagram illustrating a specific liquid container according to another embodiment.

In each of the embodiments described above, the second identifier 36 of the specific liquid container 10 is recorded on the recording medium 32 of the circuit board 30. However, the second identifier 36 is not limited to this but may be recorded in another form in the specific liquid container 10. FIG. 13 is a diagram illustrating a specific liquid container 190 according to another embodiment. The specific liquid container 190 is a container that accommodates a liquid, and is, for example, a bottle that is used for replenishing a liquid cartridge with a liquid when the liquid in the liquid cartridge attached to the holder 2 is used up. The specific liquid container 190 includes an inlet 192 and a container main body 194. The second identifier 36 is, for example, a two-dimensional barcode and is recorded by being printed on the container main body 194. The second identifier 36 is not limited to the two-dimensional barcode but may be alphanumeric characters or other identifiable elements.

In this case, when a liquid cartridge is replenished with a liquid, the acquisition section 64, 94 requests the outside to acquire the second identifier 36. The acquisition request is performed, for example, by displaying, on a monitor of the specific liquid ejecting apparatus 50 or the control device 9, a message indicating that an image of the second identifier 36 is to be captured by a camera or the like and the captured image data is to be input to the specific liquid ejecting apparatus 50. The contractor 150 captures an image of the second identifier 36 and inputs the captured image data to the specific liquid ejecting apparatus 50. Subsequently, the determination section 66 compares the first identifier 68 with the second identifier 36 and determines whether the specific liquid container 190 is usable.

D-2. Second Other Embodiment

Figure 14:
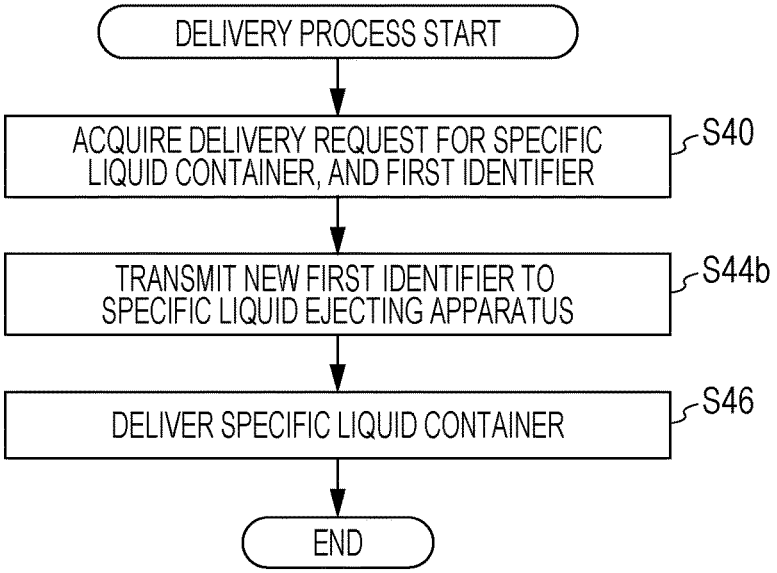
FIG. 14 is a flowchart illustrating a delivery process according to a second other embodiment.

FIG. 14 is a flowchart illustrating a delivery process according to a second other embodiment. The delivery process according to the second other embodiment is a modified form of the delivery process executed by the delivery system 200*a* according to the second embodiment illustrated in FIG. 9. Accordingly, steps that are substantially the same as those in the second embodiment are denoted by substantially the same reference numerals, and description thereof is omitted.

In step S44*b*, in response to a delivery request, the server 90 transmits a new first identifier 68*a* corresponding to the specific liquid container 10 to be delivered to the contractor 150, to the specific liquid ejecting apparatus 50 having the first identifier 68 of the delivery request source. Specifically, upon acquiring ordering information, the vendor 80 selects the specific liquid container 10 that satisfies the ordering information such as the quantity and ink color, from items in stock, and carries out preparatory work for delivery of the selected specific liquid container 10 to the contractor 150. Prior to delivery, the vendor 80 transmits the first identifier 68*a* corresponding to the specific liquid container 10 to be delivered to the contractor 150, to the server 90, and the server 90 transmits the received first identifier 68*a* to the control driver 92 via the network 70. Upon receiving the first identifier 68*a*, the control driver 92 transmits the first identifier 68*a* to the specific liquid ejecting apparatus 50 having the first identifier 68. The first identifier 68*a* transmitted from the server 90 is stored in the storage section 67 of the specific liquid ejecting apparatus 50. Subsequently, in step S46, the vendor 80 delivers the specific liquid container 10 to the contractor 150. Like the first identifier 68 and the second identifier 36, the first identifier 68*a* is, for example, expressed by a combination of two or more alphanumeric characters, or the like. According to the present embodiment, the first identifier 68*a* is generated such that the second identifier 36 includes information related to the first identifier 68*a*.

Figure 15:
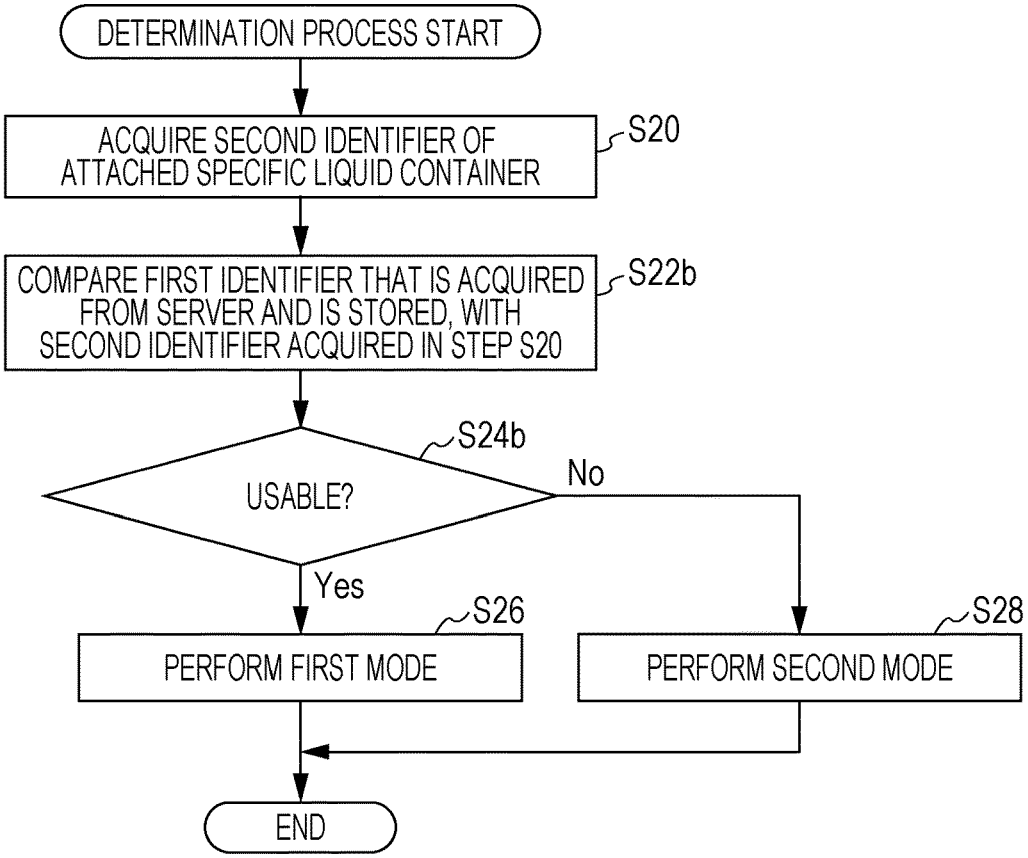
FIG. 15 is a flowchart illustrating a determination process according to the second other embodiment.

FIG. 15 is a flowchart illustrating a determination process executed by the control section 6 of the specific liquid ejecting apparatus 50 according to the second other embodiment. The determination process is executed when the specific liquid container 10 or the liquid container 10*t* is attached to the holder 2. According to the present embodiment, the determination process is executed immediately after the specific liquid container 10 or the liquid container 10*t* is attached to the holder 2. However, the determination process is not limited to this, but may be executed after a predetermined amount of a liquid has been consumed. Differences from the determination process illustrated in FIG. 10 are process details of step S22*b* and step S24*b*. The other steps are substantially the same as those in the determination process illustrated in FIG. 10. Thus, substantially the same steps are denoted by the same reference numerals, and description thereof is omitted.

In step S22*b*, the determination section 66*a* compares the first identifier 68*a* that is acquired in advance from the server 90 and is stored, with the second identifier 36 acquired in step S20. In step S24*b*, the determination section 66*a* determines whether the specific liquid container 10 or the liquid container 10*t* attached to the holder 2 is usable for the specific liquid ejecting apparatus 50. Specifically, if the first identifier 68*a* that is acquired from the server 90 and is stored matches the second identifier 36 acquired by the acquisition section 64 in step S20, the determination section 66*a* determines that the specific liquid container 10 is usable. However, if the first identifier 68*a* that is acquired from the server 90 and is stored does not match the second identifier 36 acquired in step S20, or if the second identifier 36 is not included in the information acquired in step S20, the determination section 66*a* determines that the specific liquid container 10 or the liquid container 10*t* is not usable.

According to the second other embodiment described above, substantially the same advantages are achieved for the points having substantially the same configuration as in the first embodiment described above. According to the second other embodiment described above, the server 90 transmits the first identifier 68*a* corresponding to the specific liquid container 10 to be delivered, to the specific liquid ejecting apparatus 50 having the first identifier 68. By using the transmitted and stored first identifier 68*a* and the second identifier 36 acquired by the acquisition section 64, the determination section 66 determines whether the specific liquid container 10 is usable. This may reduce the possibility that the liquid container 10*t*, which is outside the coverage of the specific service plan, might be used for the specific liquid ejecting apparatus 50. The first identifier 68*a* corresponding to the specific liquid container 10 to be delivered is transmitted to the specific liquid ejecting apparatus 50. Thereby, the specific liquid container 10 may be manufactured and stored prior to order placement.

D-3. Third Other Embodiment

In each of the embodiments described above, a plurality of specific liquid ejecting apparatuses 50 covered by the same specific service plan are provided, although this is not a limitation. For example, one specific liquid ejecting apparatus 50 may be covered by the same specific service plan.

E. Other Aspects

The present disclosure is not limited to the embodiments described above and may be implemented in various aspects without departing from the scope of the gist thereof. For example, the technical features in embodiments corresponding to the technical features in each of the aspects described in the Summary section may be replaced or combined as appropriate in order to solve some or all of the problems described above or in order to achieve some or all of the advantages described above. Additionally, the technical features may be deleted as appropriate unless described herein as being essential.

1. According to an aspect of the present disclosure, a liquid ejecting system is provided. The liquid ejecting system includes a specific liquid ejecting apparatus having a first identifier indicative of coverage by a specific service plan, and a specific liquid container having a second identifier indicative of coverage by the specific service plan. The specific liquid ejecting apparatus includes an acquisition section that acquires the second identifier, and a determination section that compares the first identifier with the acquired second identifier and determines whether the specific liquid container is usable for the specific liquid ejecting apparatus. According to the aspect, the first identifier and the second identifier, which are indicative of coverage by the specific service plan, are compared, and thus it is determined whether the specific liquid container is usable. This may reduce the possibility that a liquid container that is outside the coverage of the specific service plan, might be used for the specific liquid ejecting apparatus.

2. In the aspect described above, the second identifier may include information related to the first identifier of the specific liquid ejecting apparatus. According to this aspect, the second identifier includes information related to the first identifier. It is therefore easier for the determination section to determine whether the specific liquid container is usable.

3. In the aspect described above, a plurality of the specific liquid ejecting apparatuses may be provided, and the second identifier may include information related to the respective first identifiers of the plurality of the specific liquid ejecting apparatuses. According to this aspect, even when a plurality of specific liquid ejecting apparatuses are provided, it is easier for the determination section to determine whether the specific liquid container is usable.

4. In the aspect described above, the specific service plan may be a flat-rate service plan. According to this aspect, the flat-rate service plan is provided.

5. In the aspect described above, the specific service plan may be a usage-based service plan in which a fixed fee is charged when an amount of usage of the specific liquid ejecting apparatus is less than or equal to a predetermined amount of usage. According to this aspect, the usage-based service plan is provided.

6. In the aspect described above, an identifier generating device that generates the second identifier from the first identifier by using a predetermined algorithm may further be included. According to this aspect, the second identifier may be easily generated from the first identifier.

7. According to an aspect of the present disclosure, a specific liquid container is provided.

The specific liquid container includes a container main body that accommodates a liquid for supply to a specific liquid ejecting apparatus having a first identifier indicative of coverage by a specific service plan, and a second identifier indicative of coverage by the specific service plan. The second identifier includes information related to the first identifier so as to enable the specific liquid container to be used for the specific liquid ejecting apparatus. According to this aspect, it may be easy to differentiate between the specific liquid container that is usable for the specific liquid ejecting apparatus and a liquid container that is not usable for the specific liquid ejecting apparatus.

8. In the aspect described above, a plurality of the specific liquid ejecting apparatuses may be provided, and the second identifier may include information related to the respective first identifiers of the plurality of the specific liquid ejecting apparatuses. According to this aspect, it may be easier to differentiate between the specific liquid container that is usable for the specific liquid ejecting apparatus and the liquid container that is not usable for the specific liquid ejecting apparatus.

9. According to another aspect of the present disclosure, a method for providing a second identifier indicative of coverage by a specific service plan, to a specific liquid container, is provided. The specific liquid container is usable for a specific liquid ejecting apparatus having a first identifier indicative of coverage by the specific service plan. This provision method includes generating the second identifier from the first identifier by using a predetermined algorithm, and providing the generated second identifier to the specific liquid container. According to this aspect, the second identifier indicative of coverage by the specific service plan is generated from the first identifier and is provided to the specific liquid container. Therefore, the specific liquid container covered by the specific service plan may be easily manufactured.

10. According to another aspect of the present disclosure, a delivery system that delivers a specific liquid container having a second identifier indicative of coverage by a specific service plan is provided. The delivery system includes a liquid ejecting system including a specific liquid ejecting apparatus having a first identifier indicative of coverage by the specific service plan, and the specific liquid container having the second identifier indicative of coverage by the specific service plan, and a server that is communicably coupled to the liquid ejecting system via a network and manages order receipt and delivery of the specific liquid container. In the delivery system, the specific liquid ejecting apparatus includes an acquisition section that acquires the second identifier, and a determination section that determines whether the specific liquid container is usable for the specific liquid ejecting apparatus. The server transmits the second identifier of the specific liquid container to be delivered, to the specific liquid ejecting apparatus having the first identifier. The determination section determines that the specific liquid container is usable when the second identifier transmitted from the server matches the second identifier acquired by the acquisition section. According to this aspect, the server transmits the second identifier of a specific liquid container to be delivered, to the specific liquid ejecting apparatus having the first identifier, and the determination section determines, by using the second identifier, whether the specific liquid container is usable. This may reduce the possibility that a liquid container that is outside the coverage of the specific service plan might be used for the specific liquid ejecting apparatus.

11. According to another aspect of the present disclosure, a liquid ejecting system is provided. The liquid ejecting system includes a specific liquid ejecting apparatus having a first identifier indicative of coverage by a specific service plan, a specific liquid container having a second identifier indicative of coverage by the specific service plan, and a server communicably coupled to the specific liquid ejecting apparatus via a network. The server includes an acquisition section that acquires the first identifier and the second identifier, a determination section that compares the acquired first identifier with the acquired second identifier and determines whether the specific liquid container is usable for the specific liquid ejecting apparatus, and a notification section that notifies the specific liquid ejecting apparatus of a determination result of the determination section. According to this aspect, the server compares the first identifier with the second identifier and determines whether the specific liquid container is usable for the specific liquid ejecting apparatus. This may reduce the possibility that a liquid container that is outside the coverage of the specific service plan might be used for a specific liquid ejecting apparatus.

The present disclosure may be implemented by, in addition to the aspects described above, aspects of a method for manufacturing the liquid container, a computer program for implementing the manufacturing method and the provision method, a non-transitory recording medium on which the computer program is recorded, and so on.

What is claimed is:

1. A liquid ejecting system, comprising:

a specific liquid ejecting apparatus having a first identifier indicative of coverage by a specific service plan;

a specific liquid container having a second identifier indicative of coverage by the specific service plan; and an identifier generating device that generates the second identifier from the first identifier by using a predetermined algorithm, wherein the specific liquid ejecting apparatus includes an acquisition section that acquires the second identifier, and a determination section that compares the first identifier with the acquired second identifier and determines whether the specific liquid container is usable for the specific liquid ejecting apparatus.

2. The liquid ejecting system according to claim 1, wherein the second identifier includes information related to the first identifier of the specific liquid ejecting apparatus.

3. The liquid ejecting system according to claim 2, wherein a plurality of the specific liquid ejecting apparatuses are provided, and wherein the second identifier includes information related to the respective first identifiers of the plurality of the specific liquid ejecting apparatuses.

4. The liquid ejecting system according to claim 1, wherein the specific service plan is a flat-rate service plan.

5. The liquid ejecting system according to claim 1, wherein the specific service plan is a usage-based service plan in which a fixed fee is charged when an amount of usage of the specific liquid ejecting apparatus is less than or equal to a predetermined amount of usage.

6. The liquid ejecting system according to claim 1, wherein the second identifier is not created until after the first identifier is created.

7. The liquid ejecting system according to claim 1, wherein the first identifier remains with the specific liquid ejecting apparatus from a start of the specific service plan.

8. A specific liquid container, comprising:

a container main body that accommodates a liquid for supply to a specific liquid ejecting apparatus having a first identifier indicative of coverage by a specific service plan; and a second identifier indicative of coverage by the specific service plan;

wherein the second identifier is generated from the first identifier by using a predetermined algorithm, and wherein the second identifier includes information related to the first identifier so as to enable the specific liquid container to be used for the specific liquid ejecting apparatus.

9. The specific liquid container according to claim 8, wherein a plurality of the specific liquid ejecting apparatuses are provided, and wherein the second identifier includes information related to the respective first identifiers of the plurality of the specific liquid ejecting apparatuses.

10. A provision method for providing a second identifier indicative of coverage by a specific service plan, to a specific liquid container, the specific liquid container being usable for a specific liquid ejecting apparatus having a first identifier indicative of coverage by the specific service plan, the provision method comprising:

generating the second identifier from the first identifier by using a predetermined algorithm; and providing the generated second identifier to the specific liquid container.

11. A delivery system that delivers a specific liquid container having a second identifier indicative of coverage by a specific service plan, comprising:

a liquid ejecting system including a specific liquid ejecting apparatus having a first identifier indicative of coverage by the specific service plan, and the specific liquid container having the second identifier indicative of coverage by the specific service plan;

a server that is communicably coupled to the liquid ejecting system via a network and manages order receipt and delivery of the specific liquid container; and an identifier generating device that generates the second identifier from the first identifier by using a predetermined algorithm, wherein the specific liquid ejecting apparatus includes an acquisition section that acquires the second identifier, and a determination section that determines whether the specific liquid container is usable for the specific liquid ejecting apparatus, wherein the server transmits the second identifier of the specific liquid container to be delivered, to the specific liquid ejecting apparatus having the first identifier, and wherein the determination section determines that the specific liquid container is usable when the second identifier transmitted from the server matches the second identifier acquired by the acquisition section.

12. A liquid ejecting system, comprising:

a specific liquid ejecting apparatus having a first identifier indicative of coverage by a specific service plan;

a specific liquid container having a second identifier indicative of coverage by the specific service plan;

a server communicably coupled to the specific liquid ejecting apparatus via a network; and an identifier generating device that generates the second identifier from the first identifier by using a predetermined algorithm, wherein the server includes an acquisition section that acquires the first identifier and the second identifier, a determination section that compares the acquired first identifier with the acquired second identifier and determines whether the specific liquid container is usable for the specific liquid ejecting apparatus, and a notification section that notifies the specific liquid ejecting apparatus of a determination result of the determination section.

* * * * *